US005557863A

United States Patent [19]

Kokkala

[11] Patent Number: 5,557,863

[45] Date of Patent: Sep. 24, 1996

[54] BLOW DEVICE FOR A DRYER SECTION OF A PAPER MACHINE

[75] Inventor: Hannu Kokkala, Turku, Finland

[73] Assignee: Valmet Corporation, Helsinki, Finland

[21] Appl. No.: 420,751

[22] Filed: Apr. 12, 1995

[51] Int. Cl.[6] ..... F26B 9/00

[52] U.S. Cl. ..... 34/629; 34/117; 34/455

[58] Field of Search ..... 34/629, 117, 120, 34/455, 456, 458

[56] References Cited

U.S. PATENT DOCUMENTS

| | | | |
|---|---|---|---|
| 3,384,973 | 5/1968 | Johansson | 34/455 |
| 4,602,439 | 7/1986 | Eskelnen et al. | 34/456 |
| 4,628,618 | 12/1986 | Virta et al. | 34/116 |
| 4,809,445 | 5/1989 | Meyer et al. | 34/120 |
| 5,101,577 | 4/1992 | Wedel | 34/117 |
| 5,214,861 | 6/1993 | Vuorinen | 34/117 |
| 5,477,624 | 12/1995 | Haessner et al. | 34/120 |

FOREIGN PATENT DOCUMENTS

| | | |
|---|---|---|
| 69332 | 9/1985 | Finland . |
| 91176 | 2/1994 | Finland . |
| 9428241 | 12/1994 | WIPO . |

*Primary Examiner*—John T. Kwon

*Attorney, Agent, or Firm*—Steinberg, Raskin & Davidson P.C.

[57] ABSTRACT

A blow device for a dryer section of a paper machine in which an air blowing is produced to support the paper web or equivalent. The device includes structure for defining an interior air space into which the air to be blown is passed through a duct communicating therewith and nozzle openings through which the air is blown to support the paper web or equivalent. The device also includes sets of equalizing plates through which the air is passed out of the air space into separate chamber spaces from which the air is passed into the nozzle openings.

13 Claims, 3 Drawing Sheets

BLOW DEVICE FOR A DRYER SECTION OF A PAPER MACHINE

BACKGROUND OF THE INVENTION

The present invention relates to a blow device for a dryer section of a paper machine by means of which a blowing is produced to support a paper web or equivalent. The device comprises means defining an air space or chamber into which the air to be blown is passed through an associated duct, and nozzle openings communicating with the air chamber and through which the air is blown so as to support the paper web or equivalent.

In recent years, the running speeds of paper machines have become higher and as a result, fluttering of the web and its separation from the support fabric have caused problems which are detrimental to the runnability of the paper machine. These problems have occurred in particular in connection with single-wire draw, in which the web runs from a first row of cylinders to a second row of cylinders on support of a drying wire whereby on the first row of cylinders, the web is situated between the drying wire and the cylinder face, and on the second row of cylinders, the web is situated outside and the drying wire is situated between the cylinder face and the web. The web runs over the draws between the rows of cylinders on support of the drying wire. It is an advantage of this single-wire draw that the web is constantly supported by the drying wire and the web has no open draws, or at least no substantially long open draws, whereby the risk of wrinkles in and breaks of the web is reduced.

It is well known in the art that a think layer of air follows the moving faces so that no relative movement takes place between the air and the moving face, but rather those particles of air that are in contact with the moving face travel at the same speed as the face. In dryer sections of paper machines, these moving layers of air produce various flows and, with a view toward controlling the problems resulting from these flows, in paper and board machines, in the area of single-wire draw, various blow boxes have been used for supporting the web. One blow box of this sort is described in Finnish Patent No. 69,332 corresponding to U.S. Pat. No. 4,628,618.

Circulation air of the paper machine has often been used as the air in these blow boxes, which circulation air may contain various contaminations, such as dust, which may block the nozzle slots in the blow box so that the operation of the blow box deteriorates. For this reason, the blow boxes must be cleaned at regular intervals by various means. Generally, the blow boxes are washed with an abundant amount of water during a regular standstill period of the paper machine, for example, about four times per year. In the prior art, arrangements are known in which the blow boxes are cleaned from outside by means of a washing device which is attached, for example, to a mobile sledge. Arrangements have also been suggested in which the blow boxes are washed from inside, and in this respect reference is made to Finnish Laid-Open Publication No. 91,176 corresponding to W.I.P.O. publication no. WO 94/28241. In spite of the arrangements of cleaning, problems may also have been caused in blow boxes by a situation in which pieces of paper or board, which have been detached, for example, in connection with a web break, have had access to the nozzles in the blow box through the air supply ducts.

In the prior art constructions of blow boxes, the construction has tended to become complicated in an attempt to achieve the desired arrangement of air distribution. Also, quite frequently, the prior art devices constitute heavy constructions.

OBJECTS AND SUMMARY OF THE INVENTION

It is an object of the present invention to provide a blow box that is easy to clean and in which, at the same time, the distribution of air is accomplished in a simple manner, while, at the same time, compared with the prior art devices, a construction of lower weight is obtained.

It is further object of the invention to provide a device in which large pieces of paper, detached as a result of a web break or equivalent, cannot get access to and block the nozzles through which air is blown to support the web.

In view of achieving the objects stated above and others, the blow device in accordance with the invention comprises sets of equalizing plates through which air is passed out of an air space defined in the blow device into separate chamber spaces also defined in the blow device. The air is passed from the chamber spaces into the nozzle openings and then to support the web.

The construction of the device in accordance with the invention is simple, and for its manufacture a sheet material or various ready-pressed profile products and sheet products are used. The term "profile" is used to designate a sheet that is bent or pressed into a specific form or configuration. Compared with prior art devices, the device in accordance with the present invention has better dimensional accuracy and a construction of lower weight. Moreover, the cleaning of the device can be arranged easily without fixed equipment by using a pressure washer device in itself known. In view of distribution of air, in a preferred embodiment of the invention, the device is provided with a set of equalizing plates, and so the distribution of air in the device can be carried out in a simple manner.

The cleaning of the device in accordance with the invention requires quite little water, about 8 liters per minute, when the device is washed by means of a pressure washer device. In contrary thereto, in conventional prior art devices, the consumption of washing water was typically about 10 liters per minute per meter of length of the device.

The invention thus comprises a frame including an air space, a first air chamber, a second air chamber and nozzle openings communicating with the first and second air chambers and through which air is blown to support the paper web. The air space and first and second air chambers are separate from one another. The device has means for passing air into the air space, and sets of equalizing plates associated with the air space, and preferably coupled to a respective one of the first and second air chambers and through which air from the air space is passed into the first and second air chambers. The sets of equalizing plates define ducts through which the air is passed from the air space into the first and second air chambers. Preferably, the frame is made of a substantially planar, sheet material having a thickness from about 3 mm to about 4 mm or a metallic profile material having a thickness from about 3 mm to about 4 mm. Elongate frame means have walls which define the first and second air chambers and are made of a substantially planar sheet material. At least one end of each of the first and second air chambers is openable for cleaning. The nozzle openings are thus defined between the walls of the frame means and the frame. The sets of equalizing plates may be directly connected to the frame means which define the first and second air chambers and extend therefrom in any direction into the air space. In another embodiment, the frame extends in a longitudinal direction and the sets of equalizing plates comprise longitudinal walls extending in the longitudinal direction of the frame and a material sheet forming transverse walls positioned between the longitudinal walls such that a plurality of ducts are formed by the longitudinal walls and the transverse walls extending in the longitudinal direction.

In the following, the invention will be described in more detail with reference to the figures in the accompanying drawings. However, the invention is not strictly confined to the details of the illustrated embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
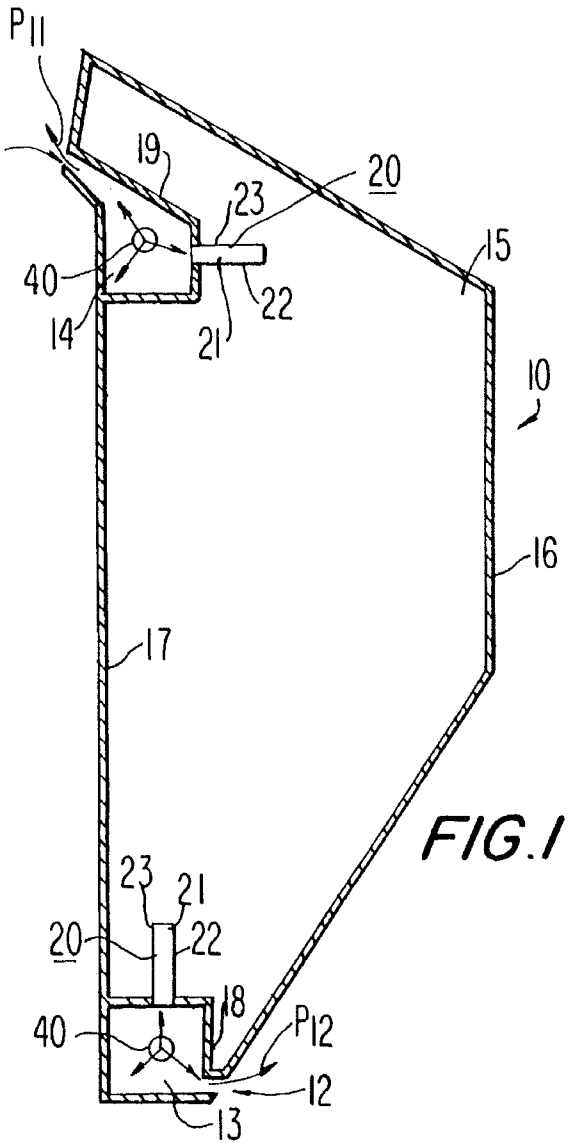
FIG. 1 is a sectional view of an exemplifying embodiment of the device in accordance with the invention.
Figure 4:
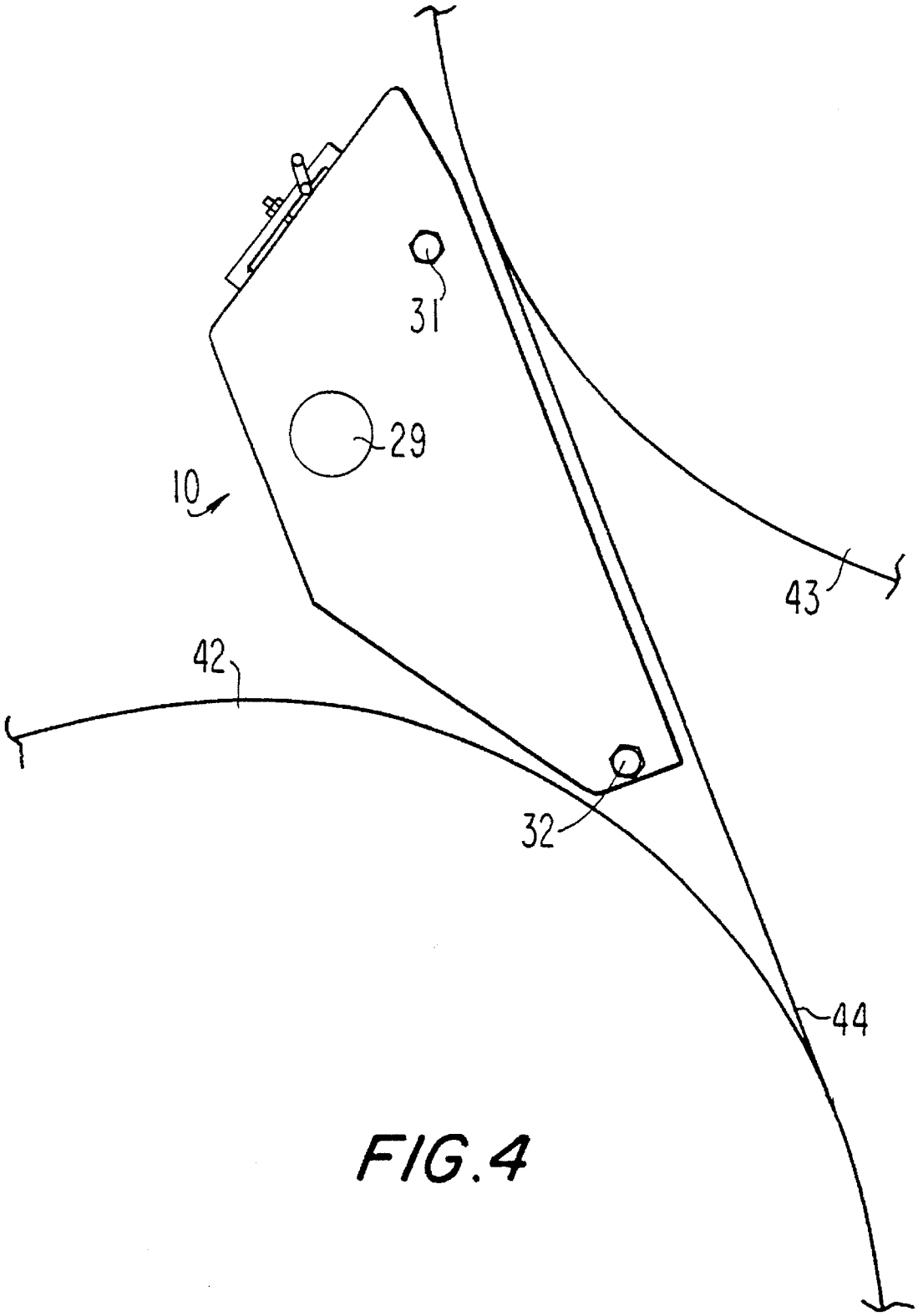
FIG. 4 is a view of the device in accordance with the invention which is arranged in a dryer section of a paper machine in the area of a single-wire draw.

Referring to the accompanying drawings wherein like reference numerals refer to the same or similar elements, in FIG. 1, a blow box in accordance with the invention is denoted generally by reference numeral 10. Blow box 10 is defined by walls 16,17,18,19 which are made, for example, of a sheet material by bending or out of prefabricated metal profiles. Air to be used to support a web is passed first into an air space 15 defined by the walls 16, 17,18,19 in an interior of the blow box 10 and then, through sets of equalizing plates 20 situated in the interior of the blow box 10 into chamber spaces or nozzle chambers 13,14. The sets of equalizing plates may extend in any direction into the air space 15, e.g., horizontally as shown by the upper set of equalizing plates or vertically as shown by the lower set of equalizing plates. Chamber spaces 13,14 are separate from the air space 15. The air is passed out of chamber spaces 13,14 through nozzle openings 11,12 as blowings $P_{11}$,$P_{12}$in the desired direction to support the web depending on the shape of the nozzle opening 11,12. The chamber spaces 13,14 are defined by the wall 17 and by additional walls 18,19, which contribute to the formation of the nozzle openings 11,12, i.e., the nozzle opening 11 is defined between wall 19 and wall 17 and nozzle opening 12 is defined between wall 18 and wall 17. The chamber spaces 13,14 are elongate and are formed such that they can be opened at least from one longitudinal end of the blow box 10, so that, during a standstill of the paper machine, a pressure washer nozzle in itself known can be inserted into these chamber spaces 13,14, by means of which the nozzle openings 11,12 of the chamber space as well as the side of each set of equalizing plates 20 that is placed toward the elongate chamber space 13,14 are cleaned. Thus, at one longitudinal end of the chamber spaces 13,14, there is an openable plug 31,32, for example, for cleaning (FIGS. 2 and 4). The sets of equalizing plates 20 extend in a transverse direction of the machine, i.e., in a direction transverse to the running direction of a web to be supported, and are made, for example, of a profile construction, which comprises longitudinal walls 22,23 and transverse walls formed by a profiled sheet of material 24, which define blow ducts 21 in their interior therebetween. The set of equalizing plates 20 can be made of metal profile, e.g., of aluminum profile or of any other sheet profile or equivalent. The term "profile", as used to describe the duct-forming material sheet in each set of equalizing plates 20, designates a sheet that is bent or pressed into a specific form or configuration, i.e., sinusoidal as shown. However the sets of equalizing plates may be in any desired configuration. In one possible embodiment as illustrated in FIG. 1, out of the nozzle opening 11, the blowing Pis passed against the running direction of the web and the wire, and out of the nozzle opening 12, the blowing $P_{12}$ is passed against the direction of rotation of the drying cylinder.

Figure 2B:
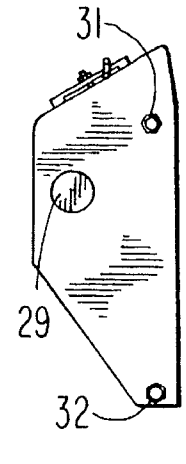
FIG. 2B is a view in the direction of arrow B of the device in accordance with the invention shown in FIG. 2.
Figure 2:
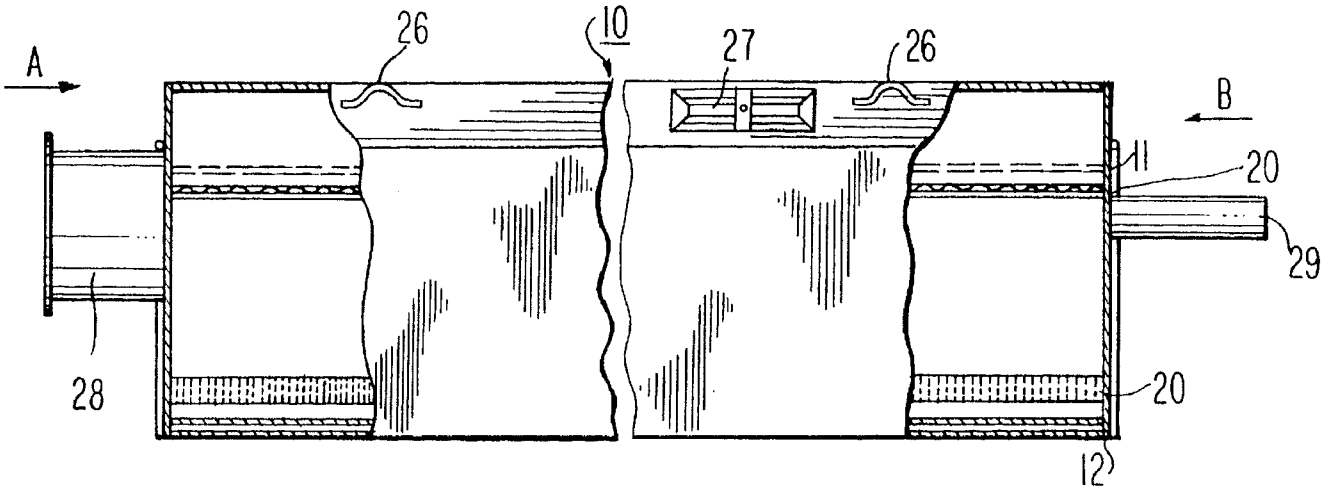
FIG. 2 is a partial view of the device in accordance with the invention.
Figure 2A:
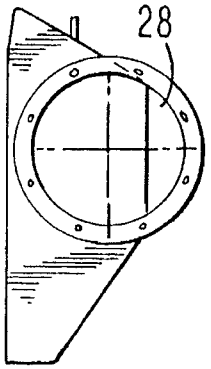
FIG. 2A is a view in the direction of arrow A of the device in accordance with the invention shown in FIG. 2.

FIGS. 2, 2A and 2B are schematic illustrations of a blow box 10 wherein both longitudinal ends of the blow box 10 are seen. An air supply pipe for supplying air to the blow box 10 is denoted with by reference numeral 28 and communicates with the air chamber 15, and a support axle of the blow box 10 is denoted by reference numeral 29. The nozzle slots of the blow box 10 are denoted by reference numerals 11 and 12, and the set of equalizing plates by reference numeral 20. Lifting brackets of the blow box 10, for carrying the same, are denoted by reference numeral 26, and a service hatch of the blow box 10, for servicing the same, is denoted by reference numeral 27.

Figure 3:
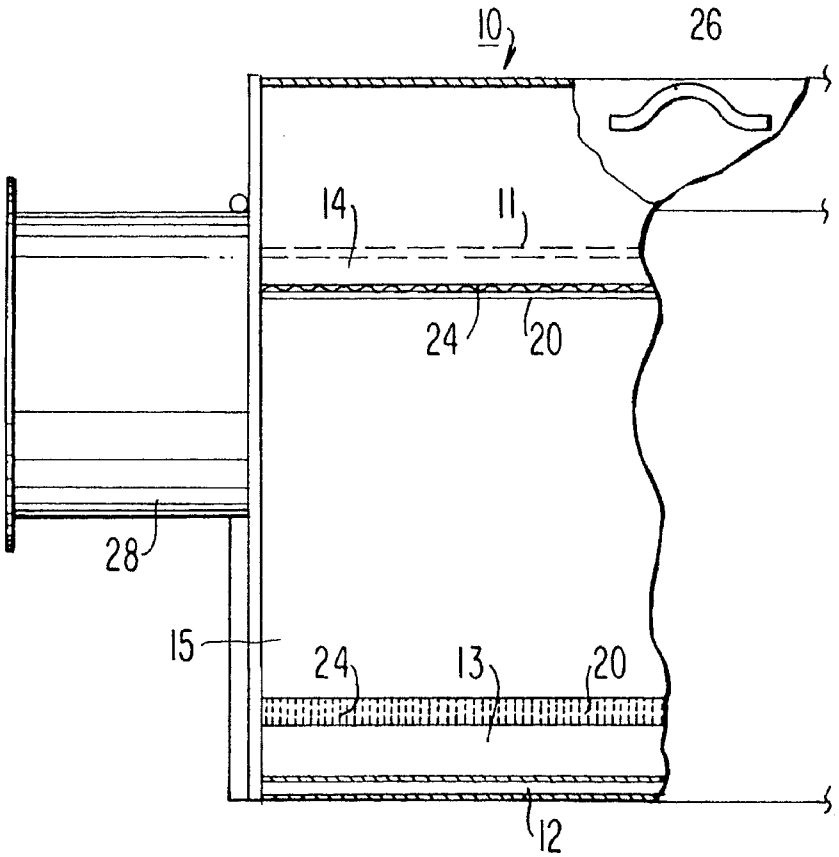
FIG. 3 is a longitudinal sectional view of the device of the invention.

FIG. 3 is a more detailed illustration of the end of the blow box 10 that is provided with the air supply opening 28. Through the duct 28, air is passed into the chamber space 15, from which it is passed further through the sets of equalizing plates 20 into the nozzle chambers 13 and 14, and from them further to the nozzle openings 11 and 12 to support the web.

In FIG. 4, the blow box 10 is shown in an application in which it is placed on the runs of a wire and paper web 44 between a pair of drying cylinders 42 and 43. The blow boxes 10 can also be used in a number of other applications in a paper machine which are in themselves known to a person skilled in the art.

In according with the invention, the blow box 10 is made of a metallic sheet material, for example steel or aluminum, whose thickness is from about 3 mm to about 4 mm, preferably 3 mm, or of a suitable prefabricated profile material made of aluminum or an equivalent material, for example Al/Mn/Si—alloy. The plates in accordance with the invention are joined together by welding or by means of some other suitable method of manufacture. In this manner, a low-weight blow box is obtained, which can be provided readily with a set of equalizing plates suitable for the distribution of air as well as with air chambers and with nozzle openings of the desired shape. Further, in this manner, the nozzle chambers can be manufactured such that they can be cleaned easily. The nozzle chambers are closed from both ends or from one end of the blow box by means of a detachable closing piece secured by plugs 31,32, through which a washing nozzle 40 (FIG. 1) can be inserted into the chamber space at the washing stage.

The examples provided above are not meant to be exclusive. Many other variations of the present invention would be obvious to those skilled in the art, and are contemplated to be within the scope of the appended claims. For example, although the blow device is described for use in conjunction with a dryer section, it is obvious that the device can be equally applicable in all stages of a paper machine wherever a blow device is needed or desired.

I claim:

1. A blow device for a dryer section of a paper machine from which air is blown to support a paper web, comprising a frame including an air space, a first air chamber, a second air chamber and nozzle openings communicating with said first and second air chambers and through which air is blown to support the paper web, said air space, said first and second air chambers being separate from one another, means for passing air into said air space, and sets of equalizing plates associated with said air space and through which air from said air space is passed into said first and second air chambers.

2. The device of claim 1, wherein each of said sets of equalizing plates defines ducts through which the air is passed from said first air chamber into a respective one of said first and second air chambers.

3. The device of claim 1, wherein said frame is made of a substantially planar, sheet material.

4. The device of claim 3, wherein the thickness of said substantially planar, sheet material is from about 3 mm to about 4 mm.

5. The device of claim 1, wherein said frame is made of a metallic profile material.

6. The device of claim 5, wherein the thickness of said metallic profile material is from about 3 mm to about 4 mm.

7. The device of claim 1, further comprising elongate frame means for defining said first and second air chambers, said frame means being made of a substantially planar sheet material, at least one end of each of said first and second air chambers being openable for cleaning.

8. The device of claim 7, wherein said frame means defining said first and second air chambers comprise walls, said nozzle openings being defined between said walls of said frame means and said frame.

9. The device of claim 7, wherein said sets of equalizing plates are directly connected to said frame means defining said first and second air chambers.

10. The device of claim 9, wherein said sets of equalizing plates extend from said frame means into said air space.

11. The device of claim 1, wherein said frame extends in a longitudinal direction, said sets of equalizing plates comprising longitudinal walls extending in the longitudinal direction of said frame and a material sheet positioned between said longitudinal walls for defining transverse walls, a plurality of ducts being defined by said longitudinal walls and said transverse walls extending in said longitudinal direction.

12. The device of claim 11 wherein said material sheet has a sinusoidal form.

13. The device of claim 1, wherein said sets of equalizing plates are connected to said first and second air chambers.

* * * * *